US006308940B1

(12) United States Patent
Anderson

(10) Patent No.: US 6,308,940 B1
(45) Date of Patent: Oct. 30, 2001

(54) ROTARY AND LONGITUDINAL SHOCK ABSORBER FOR DRILLING

(75) Inventor: Edwin A. Anderson, Houston, TX (US)

(73) Assignee: Smith International, Inc.

( * ) Notice: Subject to any disclaimer, the term of this patent is extended or adjusted under 35 U.S.C. 154(b) by 0 days.

(21) Appl. No.: 09/380,894

(22) PCT Filed: Mar. 11, 1998

(86) PCT No.: PCT/US98/04750

§ 371 Date: Sep. 11, 1999

§ 102(e) Date: Sep. 11, 1999

(87) PCT Pub. No.: WO98/50699

PCT Pub. Date: Sep. 17, 1998

Related U.S. Application Data

(60) Provisional application No. 60/040,963, filed on Mar. 12, 1997.

(51) Int. Cl.[7] ..... F16F 9/18

(52) U.S. Cl. ..... 267/125; 267/137; 175/300; 175/322

(58) Field of Search ..... 267/136, 137, 267/125; 464/20; 175/297, 300, 321, 322, 323

(56) References Cited

U.S. PATENT DOCUMENTS

| | | | | |
|---|---|---|---|---|
| 4,139,994 | * | 2/1979 | Alther | 175/321 |
| 4,257,245 | * | 3/1981 | Toelke et al. | 175/321 |
| 4,462,471 | * | 7/1984 | Hipp | 175/296 |
| 5,033,557 | * | 7/1991 | Askew | 175/297 |
| 5,224,898 | * | 7/1993 | Johnson et al. | 175/321 |
| 5,323,852 | * | 6/1994 | Corette et al. | 166/51 |
| 5,372,548 | * | 12/1994 | Wohlfeld | 464/20 |

* cited by examiner

*Primary Examiner*—Robert J. Oberleitner
*Assistant Examiner*—Devon Kramer
(74) *Attorney, Agent, or Firm*—Sean C. Henkel; Wesley T. Noah; Jack W. Hayden

(57) ABSTRACT

A rotary and longitudinal shock absorbing apparatus with an mandrel therein is connected to a drill string assembly to absorb abnormal longitudinal shocks and abnormal torsional shocks by cooperating hydraulic and mechanical means, while allowing communication of drilling fluid through the body of the apparatus. The construction of the apparatus is such that torque shock absorbing action is independent of the longitudinal shock absorbing action and the apparatus provides balanced internal and external pressure to permit its operation at all levels of hydraulic pressure.

6 Claims, 6 Drawing Sheets

ROTARY AND LONGITUDINAL SHOCK ABSORBER FOR DRILLING

This application is a 371 of PCT/US98/04750 filled Mar. 11, 1998 and also claims one fit of Provisional No. 60/040, 963 filed Mar. 12, 1997.

TECHNICAL FIELD

This invention relates to an energy absorbing device for tubular members, specifically to such devices for arresting both longitudinal and torsional shocks on tubular members used in drilling operations.

BACKGROUND ART

In the process of rotary drilling of wells, a variety of abnormal forces can cause stress on the drill string members which comprise the drill string assembly. If these abnormal forces or loads occur repetitively, they can cause failure of the drill string assembly. Down hole vibration and torque have long been associated with bit-failure and drill string failure. These various events are described as stick/slip, bit whirl, bit bounce, and bottom-hole-assembly (BHA) whirl and resonance. Although highly cost-effective, the development and deployment of new slimhole drilling techniques has been hampered by mechanical problems resulting from bit whirl and stick-slip problems.

Directional drilling programs have introduced other problems associated with various shock fatigue factors. The use of downhole motors for driving the drill bit has also been delayed because of vibrational problems associated with the forces described herein.

Although these events have long been recognized as a cause of drill string failures and a variety of tools have been developed to limit or eliminate these shocks, no generally acceptable device has been developed which is capable of absorbing the damaging overload stresses from repetitive longitudinal and rotary shocks.

A number of prior art devices have been proposed to absorb shocks in a drill or pipe string. For example, U.S. Pat. Nos. U.S. Pat. No. 2,212,153 to Eaton (1940) (relating to sucker rod vibrations only), U.S. Pat. No. 2,756,022 to Sturgeon (1956), 3,871,193 to Young (1975), U.S. Pat. No. 3,998,443 to Webb (1976), 4,600,062 to Teng (1986) and U.S. Pat. No. 4,844,181 to Bassinger (1989), each describe devices or combinations of devices to absorb axial or longitudinal shock, yet allow torque transmission to the drill string. U.S. Pat. No. 3,998,443 to Webb (1976) discloses an arrangement to absorb both longitudinal and torque shock, but limited excessive torque by translation of the torque into longitudinal movement. Thus, this patent did not independently absorb both torque and longitudinal shock in the drill string.

DISCLOSURE OF THE INVENTION

The present invention provides an shock/vibration-absorbing tool that will effectively act to reduce or eliminate abnormal shocks from being transmitted through the drill string irrespective of the source of the shock. Abnormal energy can be imparted to the drill string by a number of sources or causes. These energy loads can manifest themselves as longitudinal movement in the drill string, or torsional movement in the drill string, or both. The present invention provides a tool which acts intermediate the drill string and the bottom-whole assembly (BHA) or bit to allow progressively resistive longitudinal movement to absorb longitudinal or axial shocks as from bit bounce. Independently of that feature, the tool is designed to absorb abnormal rotation of the drill string as from bit whirl. This invention thereby prevents this abnormal energy from either source from propagating throughout the drill string assembly. The tool consists of a mandrel attached through an intermediate assembly to the lower sub assembly which both absorbs unusual energy which is transmitted, yet permits continuous torque to be transmitted to the drill bit from the surface drive means.

If the source of the energy shock originates above the tool, the mandrel is compressively moved telescopically into the drive cylinder which allows continued rotational movement, while simultaneously absorbing (through both mechanical and hydraulic means), the initial energy loading of the shock. The shock is dampened by the movement of the mandrel into the annular space provided by the drive cylinder, connector sub and compression cylinder which cooperatively and progressively resist the shock and the damaging movement of the drill string by resilient cooperating mechanical and hydraulic means.

If the source of the energy shock originates below the tool, the energy is transmitted to the tool which drives the lower sub and compression cylinder up, causing compression of the lower resilient assemblies, which in turn move the compression mandrel against the hydraulic and mechanical energy absorbing means in the drive cylinder. The dampening effect of the present invention from both directions, and independent of the rotational energy which may be continued to be imparted the drill string, realizes the long-desired but unobtained goal of a device which absorbs rotational and longitudinal shocks. The tool continues to provide rotational energy which is required to maintain movement of the drill bit on the well bottom.

A further object of this tool is to provide a tool in which the longitudinal axial shock absorbing means is separate and apart from the torque shock absorbing means.

A still further object of this tool is to provide a tool in which the longitudinal shock means will address both light and heavy shock loads.

Another object of this tool is to provide a tool in which the torque-shock absorbing means has the ability to absorb at least two complete 360° turns.

An additional object of this tool is to provide a tool for use with polycrystalline diamond compact bits in which the torque-shock absorbing means will address bit whirl, both clockwise and counterclockwise.

Another object of this tool is to provide an energy absorbing device in which the pump-out or thrust means has a low effective piston area.

Another object of this tool is to provide a tool which will absorb abnormal energy conditions in the drill string to provide the elimination of excessive torque on drill string joints, which will lessen the need for excessive force in loosening joints upon recovery of the well string.

The transmission of energy through the tool is symmetrical whether the compressive energy originates at the bit end of the tool or from above the tool. Since damage can be experienced to the mechanical top-drive units from abnormal torsional shocks, the placement of the energy-absorbing drive mechanism of the invention may be used to absorb abnormal energy being transmitted up the drill string to the drive unit.

Other objects and advantages of the tool will become apparent from a consideration of the following description and the drawings.

BEST MODE FOR CARRYING OUT THE INVENTION

Figure 1:
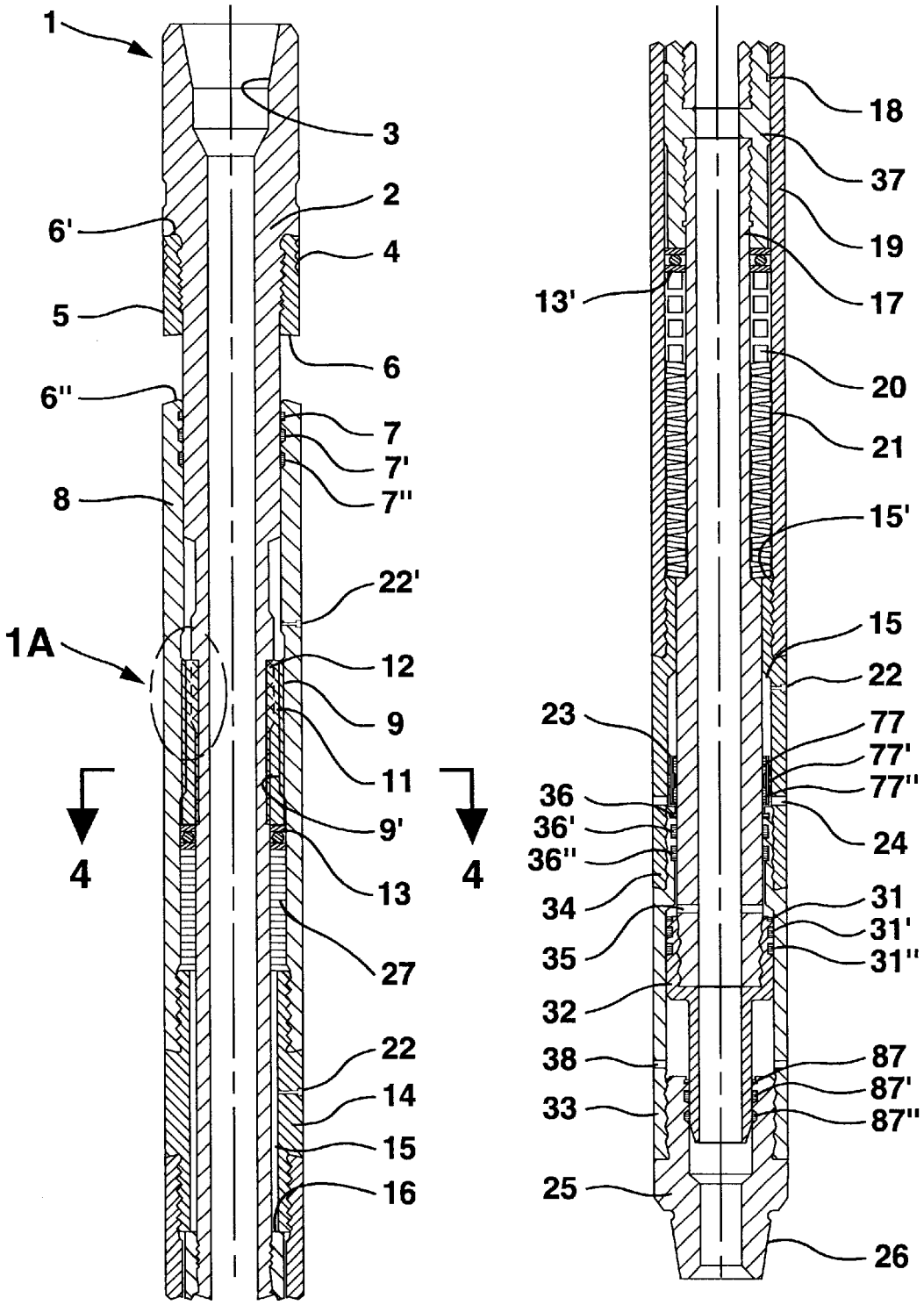
FIG. 1—A vertical section view illustrating a preferred embodiment in an uncompressed, but torqued, mode.

Referring to the drawings and in particular FIG. 1, the tool embodying the present invention is shown generally at 1 in an longitudinally uncompressed, but fully torqued, view. The tool 1 is adapted to be placed in the tubular string between a drill bit (not shown) and the remainder of the drill string which is connected to the drilling equipment at the surface. Accordingly, the tool 1 is fashioned with mandrel 2 with threaded box connection 3 to permit connection with the drill string through normal connection which may be formed in a number of different configurations well known to those skilled in the art. Mandrel body 2 is threadably connected to compression piston 37. Compression piston 37 is threadably connected to compression mandrel 17 which is threadably connected to equalizing mandrel 32, permitting telescoping longitudinal movement of such elements inside drive cylinder 8, connector sub 14, neutralizing cylinder 33 and equalizing cylinder 34 and lower sub 25. Lower sub 25 provides a threaded pin connection 26 for connection to the drill bit or bottom hole assembly in manner well known to those skilled in the art. Threaded pin connection 26 may also be connected intermediate a drill collar, which is connected to a rotary drill bit.

The tool 1 is provided with an axial flow passage therethrough to allow flow of drilling fluids through the tool without constriction. Mandrel 2 is also provided with a shoulder 6 against which is fit wear ring 5 on which wear pads 4 are placed, all fabricated of hardened or wear resistant materials, such as 4340 steel, also well known to those skilled in the art of manufacture of down-hole tools to prevent excessive wear and allow the tool to be redressed after use and reused.

Mandrel 2 is telescopically engaged in the drive cylinder 8 which is connected by connector sub 14 to compression cylinder 19. Mandrel 2 is threadably connected by compression piston 37 to compression mandrel 17, and is free to slidably move from the up-impact face 16 to the top of thrust bearing 13 which is permits engagement with light load Belleville springs 20 and heavy load Belleville springs 21. Movement of the compression mandrel 17 relative to the compression cylinder 19 is restricted by resilient members such as light load spring 20 and heavy load Belleville spring 21 which are stopped on Belleville support shoulder 15'. The choice of resilient members may be varied to permit variable resistance throughout the entire range of expecting operating loading of the tool in the wellbore.

The connection between the mandrel 2 and the drive cylinder 8 is made slideable by the cylindrical bearing surface carried on the mandrel 2 against which a plurality of fluid seals 7, 7' and 7", which provide a dynamic or sliding joint between the mandrel 2 and the drive cylinder 8 to permit longitudinal movement of the mandrel 2 relative to the drive cylinder 8.

Fluid seals 7, 7', and 7" are elastomeric sealing elements fabricated from nitrile materials, Teflon seals and elements containing brass inserts, respectively, which are configured in a manner well known to those skilled in the manufacture and installation of seals in down-hole tools. It may also be appreciated that alternative elastomeric seal means may be substituted for each of the seals described without departing from the spirit of the invention to provide a dynamic hydraulic seal. Each of the sets of packer seal elements used in the present invention: fluid seals 7, 7',7"; piston seals 77', 77"; equalizing seals 36 36', 36"; mandrel seals 31, 31', 31"; and hydraulic seals 87, 87', 87" are each formed from the same materials and are each intended to provide a sliding seal between the inner member and the outer member around each set. The neutralizer piston 23 is a sliding seal assembly permitting dynamic hydraulic sealing between the circumferential exterior of the compression mandrel 17 and the interior circumferential surface of the neutralizing cylinder 34.

A down impact face 6 is formed between the lower edge of wear rings 5, stopped against the mandrel shoulder 6" and the upper edge of drive cylinder 8. The mandrel is protected from excessive wear by wear ring 5 which is faced with wear pad 4. Seals 7, 7'and fluid seals 7" are set in the upper portion of the drive cylinder 8 to provide a dynamic hydraulic seal between the mandrel 2 and the drive cylinder 8. Drive cylinder 8 is threadably connected to connector sub 14 and encloses a torque sleeve 11, thrust bearing 13 and upper torque resisting Belleville springs 27. Drive cylinder 8 is provided with inner torque threads 9' to engage the torque sleeve 11 and its outer torque threads 9.

Figure 1A:
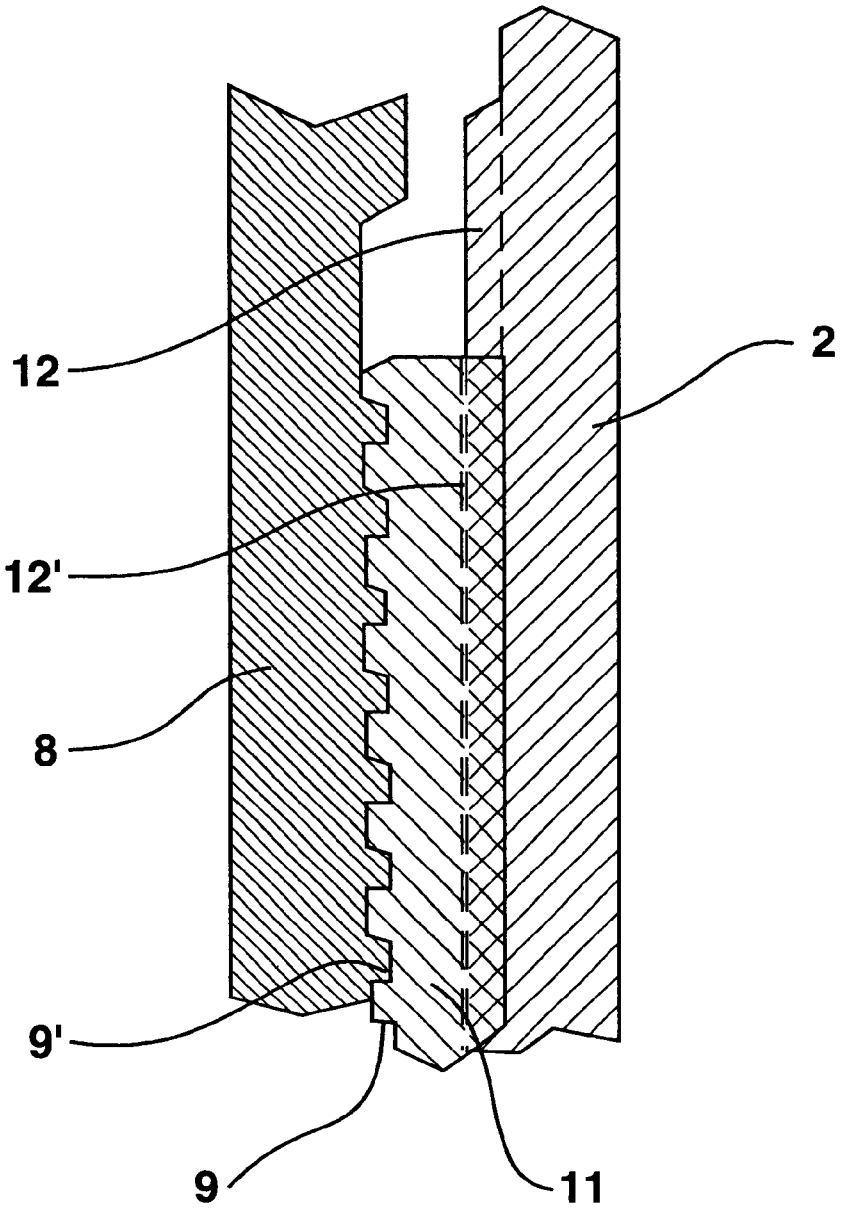
FIG. 1A—A vertical section view of the torque sleeve engagement of the drive cylinder threads with mandrel splines.

As more fully disclosed in FIG. 1A, drive cylinder 8 provides multi-lead inner torque threads 9' to engage the outer torque threads 9 on torque sleeve 11. Torque sleeve 11 has internally spline 12' to accept the external splines 12 of mandrel 2 to provide transmission of rotational energy from the drive means for the drill pipe (not shown) to the drill bit through the shock absorbing apparatus.

Drive cylinder 8 is also be fitted with a fill ports 22' to fill an inner chamber 15 formed therein with an incompressible fluid. Torque resisting Belleville spring 27 and thrust bearing 13 encircle mandrel 2 and are enclosed within the inner chamber 15 (formed by the drive cylinder seals at 7, 7' and 7" and the pistons seals at 77, 77' and 77" on the neutralizer piston 23) to provide engagement of bottom of torque sleeve 11. The inner chamber 15 extends from the fluid seals 7, 7' and 7" on drive cylinder 8 the piston to seals 77, 77' and 77" on the neutralizer piston 23 which slideably seal the tubular compression mandrel 17 and the neutralizing cylinder 34. The inner chamber 15 is isolated from the well fluids surrounding the tool 1 in the well bore and is filled with gear oil, or other incompressible fluid. Annular neutralizer piston 23, which is slideably engaged between compression mandrel 17 and neutralizer cylinder 34, dynamically seals inner chamber 15 from the well fluids allowed to communicate through neutrlizing port 24 to maintain the fluid within the inner chamber 15 at substantially the same hydrostatic pressure as the well fluid which surrounds the tool 1. The equalization of interior pressure with exterior pressure prevents the fluid seals 7, 7' and 7" and piston seals 77, 77' and 77" from experiencing substantial pressure differentials and permits slideable engagement between the mandrel 2 and lower sub 25.

As previously noted, external splines 12 are fashioned on the upper mandrel body which engage the inner splines 12' of the torque sleeve 11. The outer surface of the torque sleeve 11 is fashioned with fast lead outer torque threads 9, as more fully described in the description of FIGS. 1A, 4 and 5. As compressive forces are experienced in the drill string from above the tool in the well bore, the energy absorbed by the tool 1 is transmitted to the mandrel 2 and thence to the compression mandrel 117. Energy dampening is provided by the lower resilient members, springs 20 and 21 which are compressed against Belleville support shoulder 15' and against the hydraulic forces of the associated compression in inner chamber 15.

Figure 3:
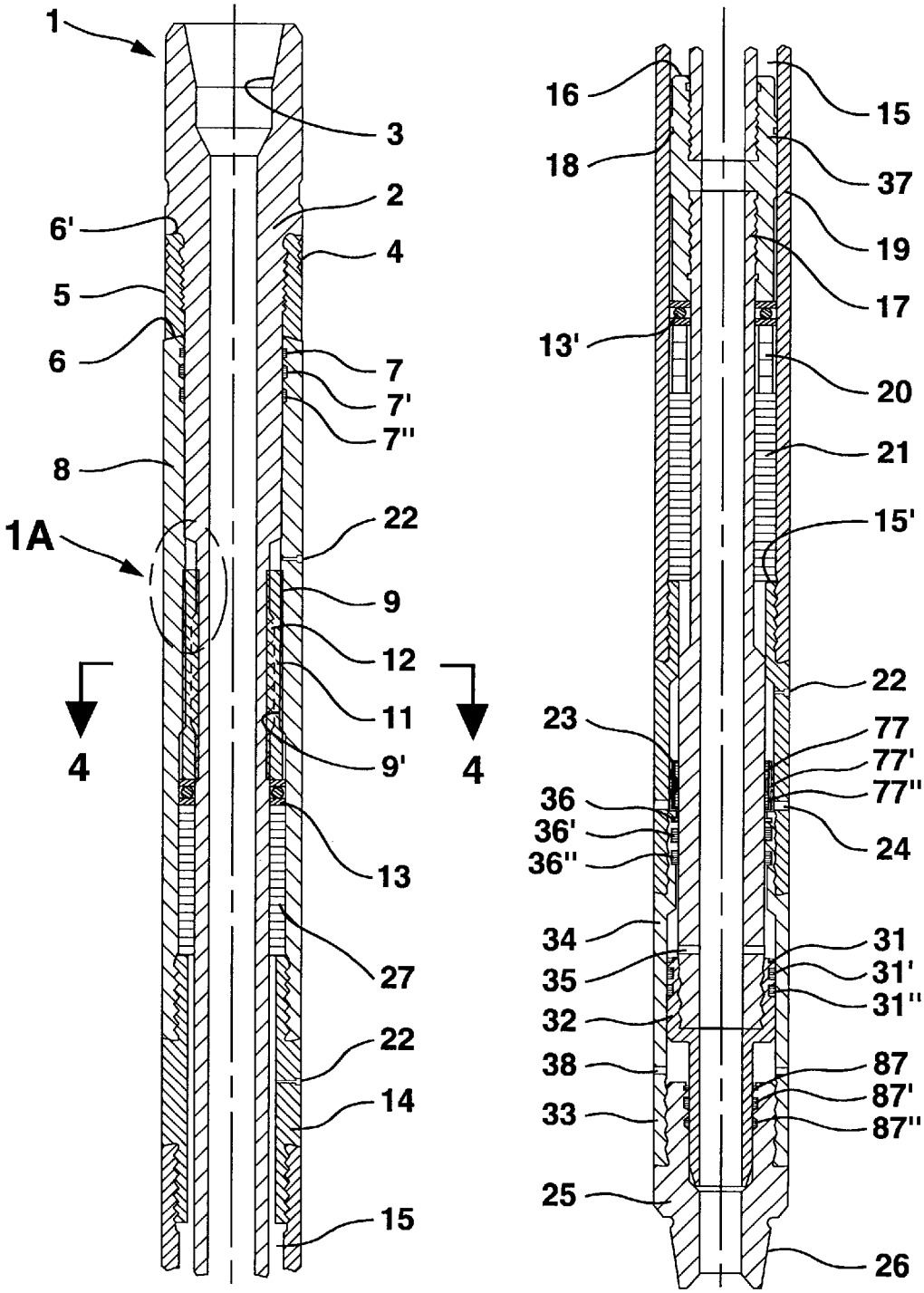
FIG. 3—A vertical section view illustrating a preferred embodiment in a comprised and torqued mode.

Similarly, abnormal torsional forces transmitted are absorbed by the movement of the torque sleeve 11 within the drive cylinder 8 which are resisted by the torque-resisting Belleville springs 27, the movement of torque sleeve 11 and the hydraulic forces of the compression in inner chamber 15. As more clearly shown in FIG. 3 showing the tool 1 in full compression, inner torque threads 9 urge the torque sleeve 11 toward compressive engagement with thrust bearing 13. These torque threads are designed to provide at least two complete 360° turns of the tool before the compression cylinder 19 will snub against the down impact face 6. Bit whirl, experienced when the bit has been released after sticking, causes drive cylinder 8 to turn at a rate relatively faster than mandrel 2 moving torque sleeve 11 up and away from further compressive engagement. A similar phenomenon occurs during milling operations intended to cut or mill a window in the casing of the wellbore to allow directional drilling. The "biting" of the mill against the casing wall causes abnormal torque to build up in the drill string causing the mill to hop off the wall before completion of the mill job. The tool 1 of the present invention may also be used to allow abnormal torque experienced by the mill to be absorbed while maintaining the mill at the casing wall permit more efficient cutting operations to continue.

Torque sleeve 11 engages the outer surface of thrust bearing 13 which allows smooth rotational engagement in compression between the torque sleeve 11 and the torque resisting Belleville springs 27, which are carried on the connector sub 14. Connector sub 14 connects drive cylinder 8 with compression cylinder 19. Compression mandrel 17 is threadably engaged with compression piston 37 and mandrel 2 and slides within compression cylinder 19. Compression piston 37 is also formed with split-ring flow restrictor 18 which retards communicating flow of the incompressible medium between the portion of the inner chamber 15 adjacent mandrel 2 and the compression mandrel 17. This space, which extends from the fluid seals 7, 7', and 7" to the piston seals 77 found on the neutralizer piston 23 permits dampening communication of the incompressible fluid. A second thrust bearing 13' is disposed between the light-load Belleville spring 20 and the lip of the compression piston 37. Light-load Belleville spring 20 abuts heavy-load Belleville spring 21 which is also disposed around the compression mandrel 17 and inner the chamber 15 formed in compression cylinder 19.

The hydrostatic pressure differentials which may be experienced between the inner chamber 15 resulting from compression of the tool 1 at various depths and with various pump pressures, and external fluids are balanced by neutralizer piston 23. Neutralizer piston 23 is formed by the cooperating dynamic piston seals 77, 77', and 77" between the exterior surface of compression mandrel 17 and the interior surface of neutralizer cylinder 34. Neutralizing piston 23 slides on both surfaces. Neutralizer port 24 allows balancing of exterior pressure through neutralizer port 24 with the interior pressure formed by the neutralizer piston 23 and dynamic equalizing seals 36, 36'and 36" which provide a dynamic seal between compression mandrel 17 and the upper portion of equalizing cylinder 33. Neutralizing cylinder 34 is threadably engaged to equalizing cylinder 33, which is threadably engaged with lower sub 25 to provide a threaded pin connection for connecting the tool 1 to other portions of the drill string or to the drill bit.

Equalizing cylinder 33 provides external equalizing ports 38 which permit exterior annular pressure to be balanced with interior pump pressure. Drilling fluids in the well annulus communicate through equalizing port 38 and balance with the hydraulic pressure which is allowed to communicate through pump port 35 to the space formed between the equalizing cylinder 33 and the equalizing mandrel 32 by the slideable engagement of mandrel seals 31, 31' and 31" between the inner wall of equalizing cylinder 33 and the equalizing mandrel 32. This equalizing mandrel is sealingly engaged in the lower sub 25 by additional hydraulic seals 87, 87' and 87". These cooperating elements provide operability of the tool 1 at all pump pressure levels and at all depths of operation.

It should be appreciated that the mandrel 2, drive cylinder 8, connector sub 14, compression cylinder 19, neutralizing cylinder 34, equalizing cylinder 33, and lower sub 25 may be formed of any suitable number of component parts to enable their assembly and relative positioning in such a telescoped relation as illustrated in FIG. 1 of the drawings without substantially departing from the spirit or intent of the invention.

Figure 2:
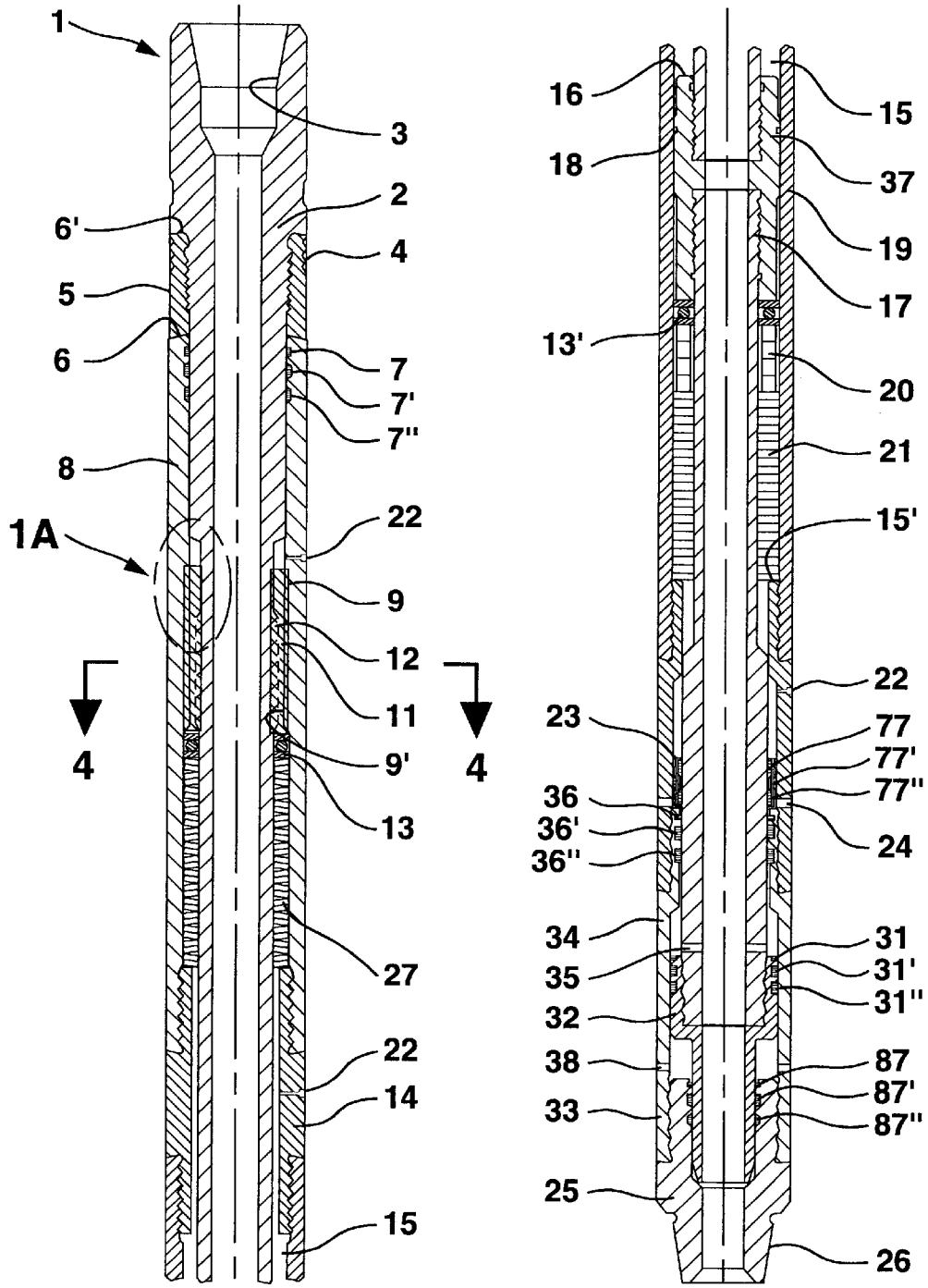
FIG. 2—A vertical section view illustrating a preferred embodiment in a compressed mode.

FIG. 2 is the tool shown in longitudinal compression. In normal use, the tool 1 is connected to the drill string intermediate the drill bit or bottom hole assembly and the drill collars. Drilling rotation moves the mandrel 2 which turn the torque sleeve 11 and move it downward to increasing resistance from the torque resisting Belleville spring 27. This continuous and vibration free transmission of torque to the drill bit.

As the drill string is rotated, mandrel 2 moves into the annular bore of the drive cylinder 8 by helical compression of the fast thread torque sleeve 11 against the torque resisting Belleville spring 27 and thereby moves compression mandrel 17 down. This helical compression by movement of the torque sleeve 11 continues until the down face 6 seats against wear ring 5. The movement of the fast thread torque sleeve 11 is additionally resisted or dampened by the incompressible fluid contained in the inner chamber 15. Longitudinal movement of the mandrel 2 into the annular bore of the drive cylinder 8 which is cooperatively engaged with the connector sub 14 and thus to the compression cylinder 19 is further resisted and energy absorbed by the movement of the compression mandrel 17 against the resistive force of the combined resistance of both the light load Belleville spring 20 and the heavy load Belleville spring 21. All of the spring elements are moving against the compression of the incompressible fluid in the inner chamber 15 further dampening movement of the compression mandrel 17 which is connected to the lower sub 25 and the remaining portion of the drill string or bit as may be required. These cooperating elements of the tool 1 resists the bit hopping up from the cutting surface and absorbs the longitudinal energy from accumulating and precipitating bit whirl as the energy is released to the bit.

FIG. 3 is the tool shown in compression as both longitudinal and torsional energy is distributed from the drive cylinder 8 throughout the tool 1. Torque sleeve 11 has moved through the drive cylinder 8, against thrust bearing 13 to compress the torque resisting Belleville spring 27 against the upper edge of connector sub 14. Simultaneously lower Belleville springs 20 and 21 are moved into full compression and the compressible fluid in the inner chamber 15 has driven equalizing piston 23 against the upper end of the lower sub 25.

Figure 4:
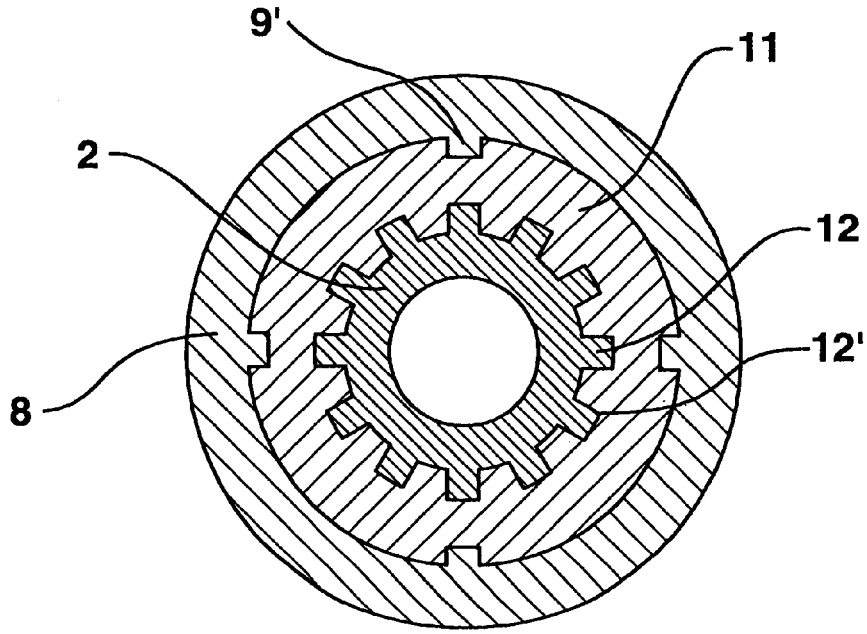
FIG. 4—A cross-section view of torque and spline sleeve section.

FIG. 4 is a top view of torque sleeve 11 engaged inside drive cylinder 8 and engaging mandrel 2. As also previously noted, inner torque threads 9' engage the outer torque threads 9 torque on sleeve 11.

Figure 5:
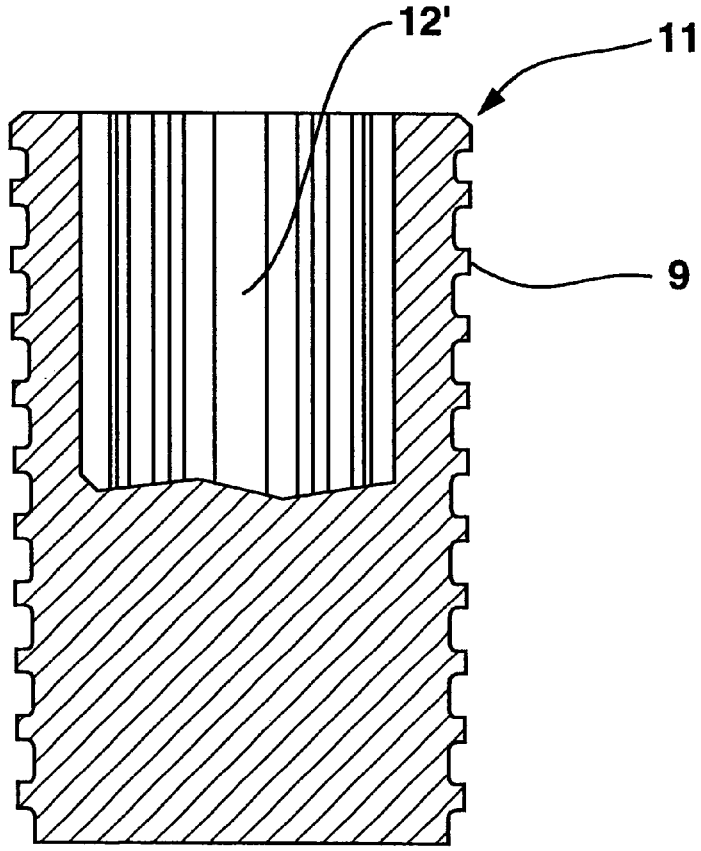
FIG. 5—A illustration showing a cut-away section of the torque sleeve splines.

FIG. 5 is part frontal view of torque sleeve with cut-away disclosing external spliner 12 on the interior of the torque sleeve 11, and reflecting the torque threads 9 on the exterior of the torque sleeve 11. A plurality of circumferentially spaced fast-lead torque threads are provided on the outer surface of the torque sleeve 11 to cooperatively engage circumferentially spaced torque threads formed on the inner surface of drive cylinder 8. A plurality of circumferentially spaced spline seats are formed on the inner surface of torque sleeve 11 to cooperatively engage the splines formed on mandrel 2 to provide rotational movement.

As previously noted, the apparatus is partially filled with a incompressible medium such as gear oil so that under normal drilling operation loads the down-impact face 6 is not contacting the upper end 6" of drive cylinder 8.

FIG. 6 is a view of the invention showing the placement of the preferred embodiment in the drill string assembly. Drill string member 28 is provided with a plurality of pony collars 29 to provide stability to the tool 1 which is shown with down impact face 6 indicating the uncompressed form. Drill bit 30 is. engaged in the lower end of the shock absorbing drive assembly 1.

Figure 6A:
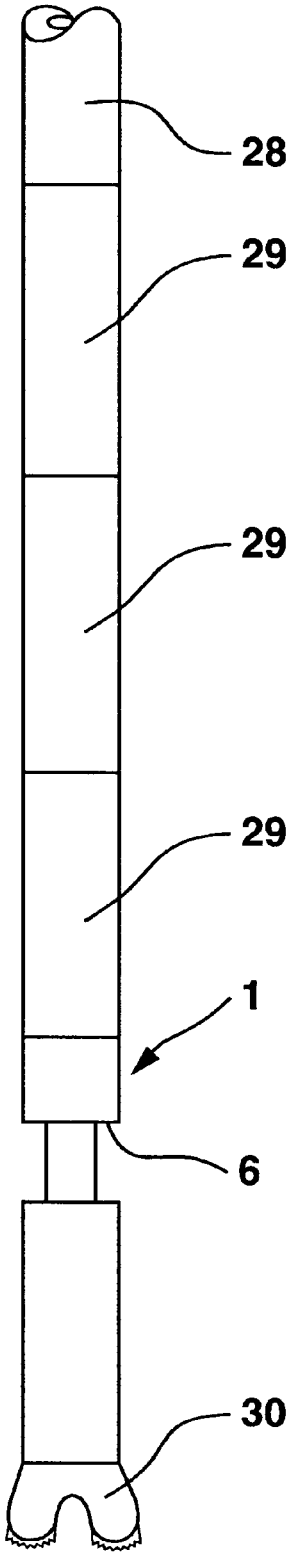
FIG. 6A—An illustration showing a preferred placement of invention attached to a drill bit.
Figure 6B:
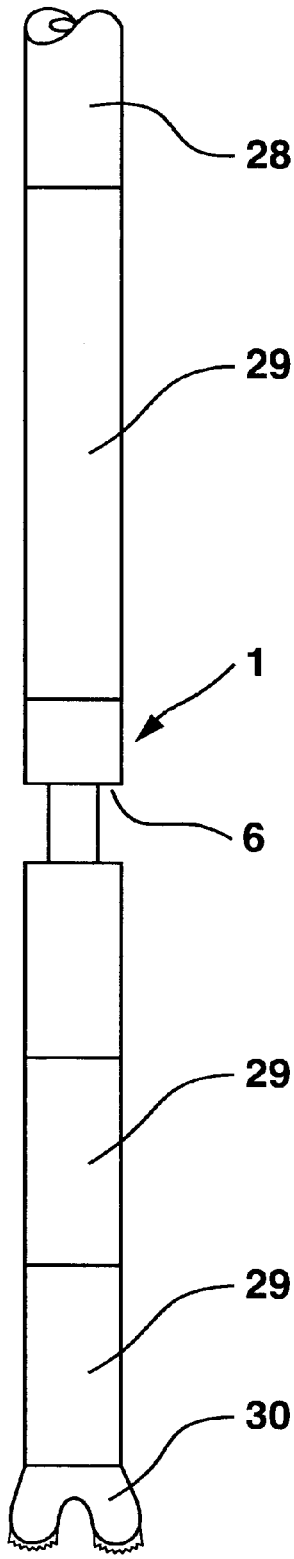
FIG. 6B—An illustration showing another placement of invention in the middle of the BHA.

As reflected in FIG. 6A, one preferred use of the tool 1 is in the bottom hole assembly immediately above the drill bit 30. Other configurations which may be used include placing the tool 1 in the middle of the BHA as shown in FIG. 6B above drill collars 29 which are connected to the drill bit 30. Since the tool 1 allows independent longitudinal loading, it may be used in conjunction with other down-hole tools such as jars and accelerators, which depend on longitudinal movement or manipulation of the drill string for their actuation.

SUMMARY, RAMIFICATIONS, SCOPE AND INDUSTRAIL APPLICABILITY

Accordingly, it may be readily appreciated that the rotary and longitudinal shock absorbing apparatus may be used at a variety of locations in long pendular strings such as in drill strings to provide shock absorbing movement of the tubular string both up and down. This tool is the first shock absorbing tool permitting longitudinal or axial shocks to be absorbed while maintaining the ability to absorb abnormal torque, thereby eliminating potential damage to expensive bits, lessening wear on drill string and bottom-hole assemblies.

Although the description above contains many specific details, these should not be construed as limiting the scope of the invention but as merely providing illustrations of some of the presently preferred embodiments of this invention. The foregoing disclosure and description of the invention are explanatory thereof, and various changes in the size, shape, and materials as well as in the details of the illustrated construction may be made without departing from the spirit of the invention.

I claim the following:

1. A rotational and longitudinal shock absorber for use in a drill string comprising:

a mandrel for connection to a drill string and providing external splines, a cylinder telescopically engaging said mandrel and having threads formed on the interior surface, seal means between the mandrel and the cylinder to form a chamber between an exterior surface of the mandrel and an interior surface of the cylinder, a torque cylinder formed with internal splines on the interior surface and external threads formed on the exterior, said interior splines engaging the splines on the mandrel and the exterior threads engaging the threads on the interior of the cylinder, resilient means carried on said mandrel, engaging a torque sleeve to resist the longitudinal movement of the torque sleeve in the interior of the cylinder and engaging said mandrel to resist the longitudinal movement of the mandrel within the cylinder.

2. The invention of claim 1 wherein said resilient means includes a plurality of springs having differing compression coefficients to progressively resist movement of the mandrel and the torque sleeve into the cylinder.

3. A rotary and longitudinal shock absorbing apparatus comprising:

a mandrel providing means for connection to a drill string and external splines, a cylinder telescopically engaging said mandrel and providing means for threaded engagement to a drill bit, seal means forming a hydraulic seal between an outer surface of said mandrel and an inner surface of cylinder, a torque sleeve having internal splines for engagement of the splines on said mandrel and external threads for engagement of threads on the cylinder, torque-resisting spring means engaging the torque sleeve and a shoulder in the cylinder providing compressive resisting force upon rotational movement of the cylinder relative to said mandrel, longitudinal-movement resisting spring means carried on a shoulder in the cylinder providing compressive resisting force upon longitudinal movement of the cylinder relative to said mandrel.

4. The invention of claim 3 wherein the torque-resisting spring means includes a Belleville spring arrangement slidingly engaging the end of the torque sleeve.

5. The invention of claim 3 wherein the longitudinal-movement resisting spring means includes a plurality of springs slidingly engaging said mandrel.

6. The invention of claim 3 wherein said sealed fluid chamber is partially filled with an incompressible fluid and pressure balanced to both pump pressure and to external hydrostatic pressure by ports permitting communication of fluids on each side of the seal means.

* * * * *